US007617052B2

(12) United States Patent
Van Kuijk et al.

(10) Patent No.: US 7,617,052 B2
(45) Date of Patent: Nov. 10, 2009

(54) ULTRASONIC ESTIMATING METHOD AND APPARATUS FOR A CASED WELL

(75) Inventors: Robert Van Kuijk, Le Plessis Robinson (FR); Jean-Luc Le Calvez, Paris (FR); Jeff Alford, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 437 days.

(21) Appl. No.: 11/426,046

(22) Filed: Jun. 23, 2006

(65) Prior Publication Data

US 2006/0289155 A1 Dec. 28, 2006

(51) Int. Cl.
*G01N 15/08* (2006.01)

(52) U.S. Cl. ..... 702/12; 702/48

(58) Field of Classification Search ..... 702/12, 702/48, 171

See application file for complete search history.

(56) References Cited

U.S. PATENT DOCUMENTS 4,545,242 A 10/1985 Chan et al.
4,685,092 A 8/1987 Dumont et al.
4,698,792 A * 10/1987 Kurkjian et al. ..... 367/31
6,041,861 A * 3/2000 Mandal et al. ..... 166/250.01
6,188,643 B1 2/2001 Liang et al.
2004/0095847 A1 * 5/2004 Hassan et al. ..... 367/25

FOREIGN PATENT DOCUMENTS

EP 0075997 6/1983
EP 1505252 2/2005

* cited by examiner

*Primary Examiner*—Bryan Bui
*Assistant Examiner*—Jonathan Teixeira Moffat
(74) *Attorney, Agent, or Firm*—Darla Fonseca; Jaime Castano

(57) ABSTRACT

An ultrasonic estimating method and apparatus are presented for estimating a mud velocity in a casing including a transducer and adapted to be positioned inside the casing and displaced through the casing at a plurality of azimuth and a plurality of depths.

11 Claims, 3 Drawing Sheets

ULTRASONIC ESTIMATING METHOD AND APPARATUS FOR A CASED WELL

CROSS REFERENCE TO RELATED APPLICATION

This application claims priority to European Patent Application 05291356.3 filed on Jun. 24, 2005.

FIELD OF THE INVENTION

An aspect of the invention relates to an ultrasonic estimating method for estimating a mud velocity flowing into a casing. Another aspect of the invention relates to an ultrasonic estimating method for estimating an inner dimension of a casing based on the mud velocity estimation.

Others aspects of the invention relate to an apparatus and to a computer program product for implementing the method of the invention.

The invention is well suited for applications to the oilfield services industry.

BACKGROUND OF THE INVENTION

Typically, a cased hydrocarbon well comprises a borehole drilled in a geological formation, a fluid-filled casing disposed in the borehole and cement disposed in an annulus between the casing and the formation.

During well logging operations, it is important to obtain information as to the current condition of the casing. The metallic casing may be exposed to various corrosion factors. For example, corrosion may be due to chemically active corrosive solutions, electrolytic corrosion due to ground currents or contact between dissimilar metals. Further, metallic casing may be subjected to wear, for example, due to abrasion from fluid flowing into the casing. Consequently, over a period of exploitation of a hydrocarbon well, the casing may deteriorate by presenting thin or weakened parts, pits, cracks or holes. Such deteriorations can potentially cause collapse of the casing, leaks of undesired fluid from the geological formation into the casing and in extreme situation loss of the hydrocarbon well. Because the casing is permanently installed in the well borehole, it is nearly impossible to remove the casing for inspection. Thus, various techniques have been developed to inspect the casing in situ to determine the presence and location of deteriorated casing parts.

For this purpose, various methods and apparatuses for characterizing a cased hydrocarbon well are known in the art. For example, the U.S. Pat. No. 6,483,777 describes an apparatus and a method for characterizing a cased well. The apparatus for characterizing a cased well comprises means for insonifying the casing with a pulsed, collimated acoustic excitation aligned at an angle greater than the shear critical angle of the fluid-casing interface, the angle being measured with respect to the normal to the local interior wall of the casing, means for receiving one or more echoes, and means for analyzing the echoes to characterize the cased well.

However, in practice, it has been found that this apparatus is commonly insufficient in order to achieve satisfactory measurements accuracy, in particular due to excessive uncertainty with regards to mud flow velocity into the casing and inner casing dimension (radius or diameter) at determined depths.

SUMMARY OF THE INVENTION

It is an object of the invention to propose an ultrasonic estimating method and apparatus that overcomes at least one of the drawbacks of the prior art.

According to a first aspect, the invention relates to an ultrasonic estimating method for estimating a mud velocity flowing into a casing by means of an ultrasonic estimating apparatus comprising a transducer and adapted to be positioned inside the casing and displaced through the casing at a plurality of azimuth and a plurality of depth.

The method comprises the steps of:

a) for a first depth and a first azimuth of the ultrasonic measuring arrangement:

a1) emitting an emission ultrasonic wave towards the casing for exciting the casing with a sensibly normal incidence, a2) receiving a reflection ultrasonic wave reflected from the casing, a3) measuring a transit time between the emitting step and the receiving step, a4) determining the casing thickness for the first azimuth, b) repeating the emitting step a1), the receiving step a2), the measuring step a3) and the determining step a4) for the first depth and at least a second azimuth of the ultrasonic measuring arrangement, c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value by applying an estimation method to the intermediate mud velocity value and an estimated first depth mud velocity value.

According to a first embodiment of the invention, the estimation method of the calculating step d) is a Kalman filtering method.

The Kalman filtering method may consist in estimating a second depth mud velocity value by calculating a sum of the estimated first depth mud velocity value with a product of a Kalman gain with a difference between the intermediate mud velocity value and the estimated first depth mud velocity value.

The Kalman gain may depend on an assumed standard deviation of the mud velocity values from the first depth to the second depth.

According to a second embodiment of the invention, the estimation method of the calculating step d) further comprises the steps of applying a generalized likelihood ratio test. The generalized likelihood ratio test is applied before the Kalman filtering method.

The generalized likelihood ratio test may consist in comparing a first hypothesis to a second hypothesis, the first hypothesis taking into consideration that the estimated first depth mud velocity value is equal to an initial mud velocity value and the second hypothesis taking into consideration that the estimated first depth mud velocity value is different to the initial mud velocity value and unknown.

According to another aspect, the invention relates to an ultrasonic estimating method for estimating an inner diameter of a casing into which flows a mud by means of an ultrasonic measuring arrangement comprising a transducer and adapted to be positioned inside the casing and displaced through the casing at a plurality of azimuth and a plurality of depth.

The method comprises the steps of:

estimating a mud velocity according to a method for estimating a mud velocity flowing into a casing according to the invention, and calculating an estimated casing inner diameter at the second depth based on the measured transit time, the diameter of the transducer and the estimated second depth mud velocity value.

According to a further aspect, the invention relates to an ultrasonic estimating apparatus for estimating a mud velocity flowing into a casing comprising a transducer and an electronic arrangement, adapted to be positioned inside the casing and displaced through the casing at a plurality of azimuth and a plurality of depth, the apparatus measuring a transit time between an emission of an ultrasonic wave towards the casing and the reception of the ultrasonic wave reflected from the casing.

The electronic arrangement comprises a processing circuit for:

a) determining the casing thickness for a first depth and a first azimuth of the transducer based on a first transit time measurement, b) determining the casing thickness for the first depth and at least a second azimuth of the transducer based on a second transit time measurement, c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value by applying an estimation method to the intermediate mud velocity value and an estimated first depth mud velocity value.

The processing circuit applies a Kalman filtering method as the estimation method. The processing circuit may further apply a generalized likelihood ratio test before applying the Kalman filtering method.

The processing circuit may further calculate an estimated casing inner diameter at the second depth based on the measured transit time, the diameter of the transducer and the estimated second depth mud velocity value.

According to still a further aspect, the invention relates to a computer program product for an ultrasonic estimating apparatus for estimating a mud velocity flowing into a casing, the apparatus comprising an ultrasonic transducer and an electronic arrangement, adapted to be positioned inside the casing and displaced through the casing at a plurality of azimuth and a plurality of depth, the apparatus measuring a transit time between an emission of an ultrasonic wave towards the casing and the reception of the ultrasonic wave reflected from the casing, the computer program product comprising a set of instructions that, when loaded into a program memory of the electronic arrangement, causes the electronic arrangement to carry out the steps of:

a) determining the casing thickness for a first depth and a first azimuth of the transducer based on a first transit time measurement, b) determining the casing thickness for the first depth and at least a second azimuth of the transducer based on a second transit time measurement, c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value by applying an estimation method to the intermediate mud velocity value and an estimated first depth mud velocity value.

The ultrasonic estimating method enables a smooth estimation of mud velocity which is insensitive to casing heterogeneity and/or ultrasonic estimating apparatus eccentricity inside the casing.

The measurement of the inner casing dimension at various depth enables the detection of localized damages in the inner casing, for example discontinuities in the casing, such as pits and holes caused by corrosion.

With the method according to the invention, the determination of the mud velocity is insensitive, at least less sensitive than with prior art method to situation where multi-layers of mud are encountered within the casing.

As a further advantage, the method and apparatus of the invention can be used with an imaging behind casing tool (IBC tool) or an ultrasonic imaging tool (USI tool). These tools require, among others parameters, the mud velocity. With the invention, these tools can provide results of better accuracy. Additionally, these tools can, provide results during logging operation without having to estimate by themselves the mud velocity in a separate pass. Further, the invention eliminates the need for these tools to have a particular arrangement (e.g. a steel reference plate) for estimating mud velocity.

These and other aspects of the invention will be apparent from and elucidated with reference to the embodiments described hereinafter.

BRIEF DESCRIPTION OF THE DRAWINGS

The present invention is illustrated by way of example and not limited to the accompanying figures, in which like references indicate similar elements.

DETAILED DESCRIPTION OF THE INVENTION

Figure 1:
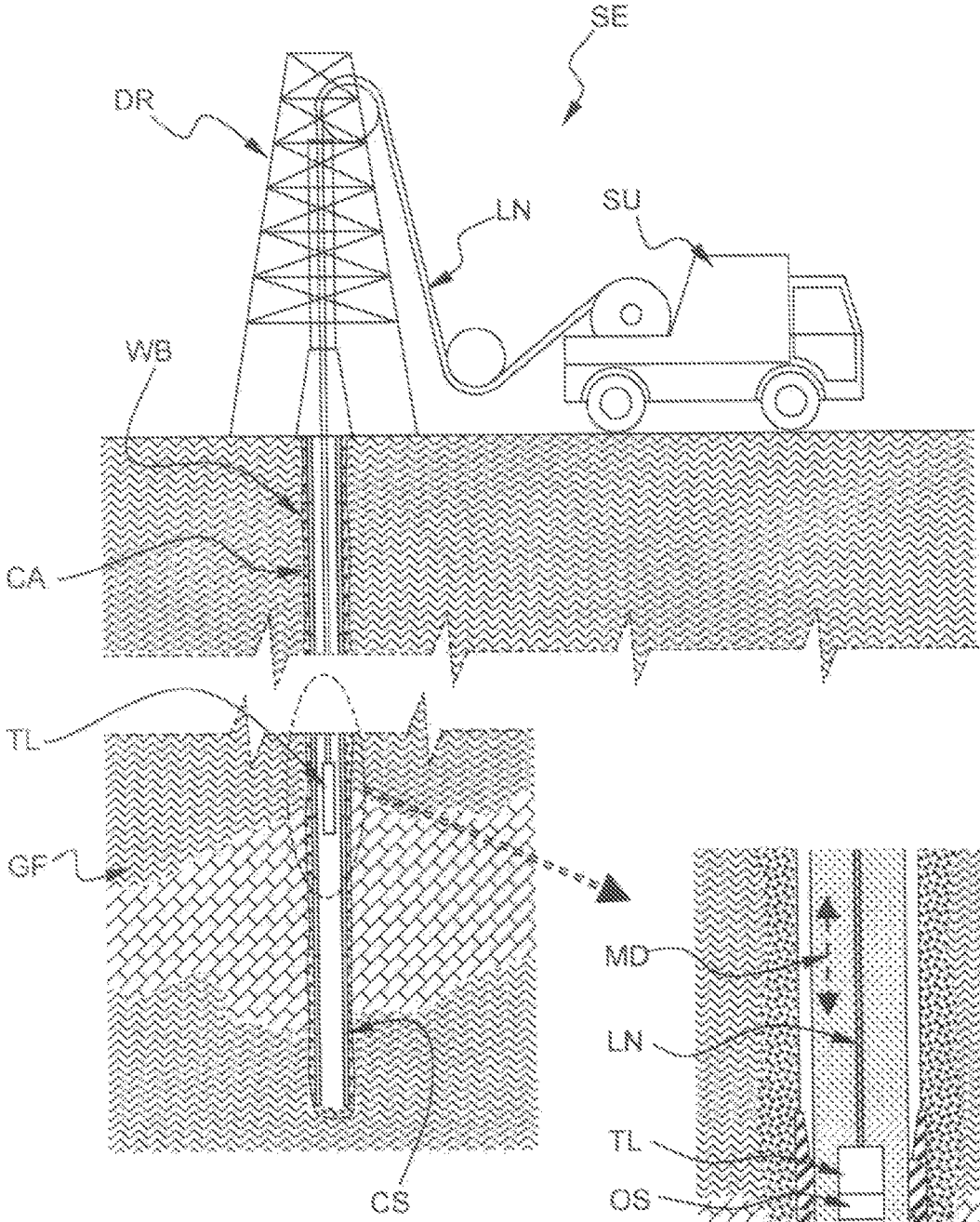
FIG. 1 is a schematical view of a typical onshore hydrocarbon well location and equipment.

FIG. 1 schematically shows a typical onshore hydrocarbon well location and surface equipments SE above a hydrocarbon geological formation GF after a well-bore WB drilling operation has been carried out, after a casing string CS has been run and after cementing operations have been carried out for sealing the annulus CA (i.e. the space between the well-bore WB and the casing string CS). The casing string function is to stabilize the well-bore.

The casing may be made of plain carbon steel, stainless steel or other material in order to withstand a variety of forces, such as collapse, burst, and tensile failure, as well as chemically aggressive fluid. Nevertheless, in harsh environment, the casing may be subject to corrosion that may affect its functionality.

At this stage, well logging operation may be carried out. The well logging operation serves to measure various parameters of the hydrocarbon well geological formation (e.g. resistivity, porosity, etc. . . . at different depths) and in the well-bore (e.g. temperature, pressure, fluid type, fluid flowrate, etc. . . . at different depths). Such measurements are performed by a logging tool TL. Generally, a logging tool comprises at least one sensor (e.g. resistivity sonde, mechanical sonde, gamma ray neutron sonde, accelerometer, pressure sensor, temperature sensor, flow-meter, etc. . . . ) and measures at least one parameter. It may include a plurality of same or different sensors measuring one or more parameters. The logging tool is moved up and down in the borehole for gathering data about the various parameters by means of a cable LN.

The cable may be an electro-optical cable comprising a fiber line protected against potential harsh environment existing in the well-bore. The electro-optical cable transmits electrical signals or optical signals from the logging tool TL to the surface unit, e.g. a vehicle SU.

The logging tool may be deployed inside the well-bore by an adapted surface equipment SE that may include a vehicle SU and an adapted deploying system, e.g. a drilling rig DR or the like. Data related to the hydrocarbon geological formation GF or to the well-bore WB gathered by the logging tool TL may be transmitted in real-time to the surface, for example to the vehicle fitted with an appropriate data collection and analysis computer and may be loaded with data collection and analysis software.

Figure 2:
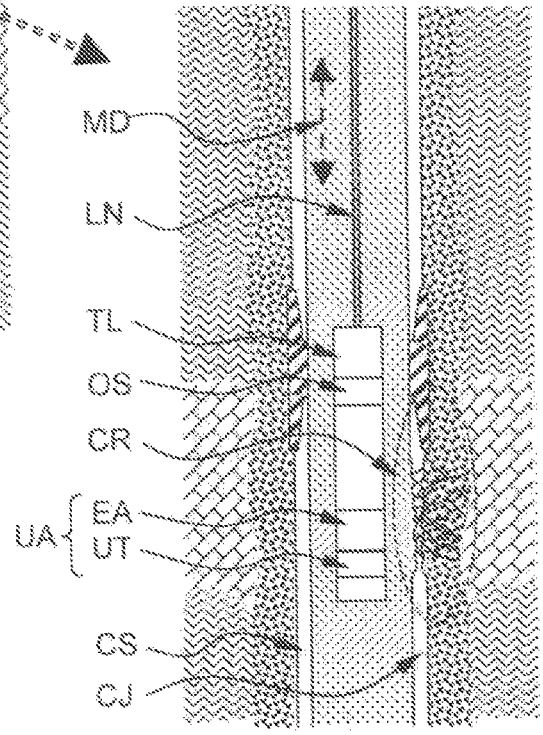
FIG. 2 is a magnified and schematical view of a portion of a cased well-bore showing a logging tool according to the invention.

FIG. 2 is a magnified view schematically showing a tool TL positioned in a portion of the cased well-bore. The tool TL comprises an ultrasonic estimating apparatus UA according to the invention. The tool TL is displaced into the casing CS which is filled with a fluid mixture, also called mud MD. The well may be a production well, namely a well producing oil and gas flowing towards the surface or an injection well, namely a well into which fluid is injected from the surface towards the geological formation.

The tool TL may also comprise other sensors OS. The tool TL provides the measurements to the surface equipment through the connection line LN. By correlating this detection with depth measurements made by the tool TL, it is possible to log flow measurements relatively to the depth.

The ultrasonic estimating apparatus may form an apparatus for estimating the mud velocity and/or an inspection tool when the mud velocity is used to determine the casing inner dimension.

In particular, the inspection tool can detect the position, shape and dimension of a corrosion zone CR affecting a casing joint CJ. The tool TL provides the measurements to the surface equipment through the connection line LN. By correlating this detection with depth measurements made by the tool TL, it is possible to run an appropriate tool down-hole for providing an appropriate remedial treatment (e.g. chemical treatment, patch, casing replacement or the like) for consolidating the corroded casing joint CJ.

The ultrasonic estimating apparatus measures the time-of-flight of a sound-pulse between emission by the ultrasonic transducer, reflection at the inner surface of the casing and reception of the reflected ultrasonic wave by the same ultrasonic transducer.

Figure 3:
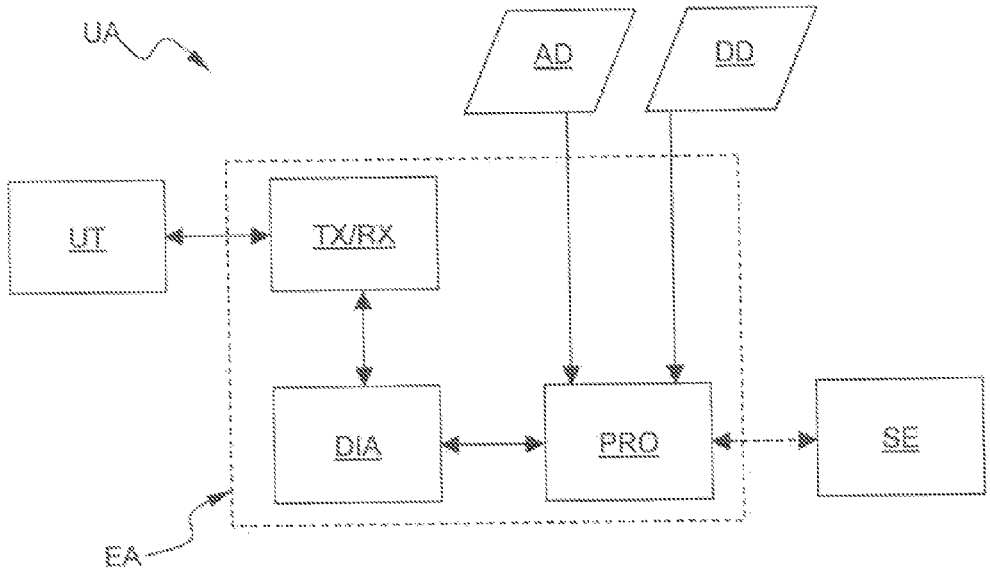
FIG. 3 schematically shows an electronic arrangement associated with the measuring arrangement according to the invention.

FIG. 3 schematically shows the ultrasonic estimating apparatus comprising an electronic arrangement EA associated with an ultrasonic transducer UT. The electronic arrangement EA comprises well known circuits associated with ultrasonic measuring device, namely a transmitter and receiver circuit TX/RX, a digitizing arrangement DIA and a processing circuit PRO.

The transmitter and receiver circuit TX/RX is connected to the ultrasonic transducer UT and to the digitizing arrangement DIA. The processing circuit PRO is connected to the digitizing arrangement DIA. The processing circuit PRO is further coupled to the surface equipment SE. The ultrasonic transducer may be mounted on a rotating sub in order to perform measurement at various azimuths. Alternatively, a plurality of transducers may be mounted, each ultrasonic transducer corresponding to a different azimuth.

Advantageously, the electronic arrangement EA is fitted within the tool TL. However, some parts may be filled into the surface unit, for example the processing circuit.

The transmitter and receiver circuit TX/RX comprises an appropriate pulse generator circuit, filtering circuit, amplification circuit and transmitter/receiver switching circuit (not shown). During an emission period, the ultrasonic transducer UT may be excited to generate an ultrasonic wave propagating into the mud MD towards the casing wall. During a reception period, the ultrasonic transducer UT generates an electrical signal induced by the reception of the ultrasonic wave reflected by the casing CS. The digitizing arrangement DIA may comprise appropriate amplifier, filter and digitizer for preparing an appropriate signal to be treated by the processing circuit PRO. The processing circuit PRO may also receive azimuth data AD and depth data DD from an azimuth measuring device and a depth measuring device (not shown), respectively. The processing circuit PRO implements the method of the invention as hereinafter described and eventually sends the results to the surface equipment SE. Alternatively, the processing circuit PRO may send raw measurements to the surface equipment SE, the implementation of the method of the invention being then performed by the processing and computing capabilities of the surface equipment.

The theoretical basis of the invention will be explained hereinafter in relation with FIGS. 4A and 4B.

During an emitting step, the ultrasonic transducer UT of the ultrasonic estimating apparatus emits an ultrasonic wave into the mud MD towards the casing with a sensibly normal incidence. During a receiving step, the ultrasonic wave reflected at the inner surface of the casing is received by the ultrasonic transducer UT. The electronic arrangement EA measures the transit time T between the emitting step (emission of the ultrasonic wave) and the receiving step (reception of the reflected ultrasonic wave).

The transit time T is proportional to the inverse of the mud velocity Vmud following the relation:

$$T = \frac{2 \cdot IR - DOT}{Vmud} \tag{1}$$

where IR is the distance between the transducer and the inner surface of the casing, and DOT is the diameter of the transducer.

In the subsequent equation, the following assumption will be made, namely that the casing outer diameter OD is known and on average depthwise constant.

The transit time T is measured (measuring step Ti MES) for a plurality of azimuth of the ultrasonic transducer.

The distance between the ultrasonic transducer and the inner surface of the casing may vary from one azimuth to another, because of the eccentricity of the tool into the casing. The number N of measured transit times acquired for each depth depends on the chosen azimuthal resolution.

The transit time Ti equation for each azimuth $1 \leqq i \leqq N$ follows the relation:

$$Ti = \frac{2 \cdot IRi - \delta i - DOT}{Vmud} \tag{2}$$

where $IR_i$ is the distance between the transducer and the inner surface of the casing for azimuth i, and $\delta_i$ is a distance offset due to the tool eccentricity.

The distance offset $\delta_i$ follows the relation:

$$\Sigma_i \delta_i = 0 \tag{3}$$

Then, the mud velocity Vmud is given by:

$$Vmud = \frac{\sum_i (2 \cdot IRi - DOT)}{\sum_i Ti} \tag{4}$$

The reflected ultrasonic wave is further processed according to the method disclosed in the mentioned prior art (U.S. Pat. No. 6,483,777), so as to determine the casing thickness $th_i$ at each azimuth. Thus, assuming a constant casing outer diameter OD, equation (4) becomes:

$$Vmud = \frac{\sum_i (OD - 2 \cdot thi - DOT)}{\sum_i Ti} \tag{5}$$

A direct calculation (intermediate mud velocity value calculating step Vmud CALC) of the mud velocity based on the preceding equation (5) typically gives a noisy curve of velocity versus depth. This is mainly due to the measurement noise, the casing defects and the variations of casing outer diameter.

As a consequence, the calculation of the inner diameter of the casing from such a directly calculated mud velocity leads to an inaccurate estimation of the inner diameter of the casing.

According to the invention, it is proposed to estimate the mud velocity by means of an estimation method. According to a first embodiment of the method, an optimal filtering method is applied. According to a second embodiment of the method, a generalized likelihood ratio test is applied before the filtering method.

Figure 4A:
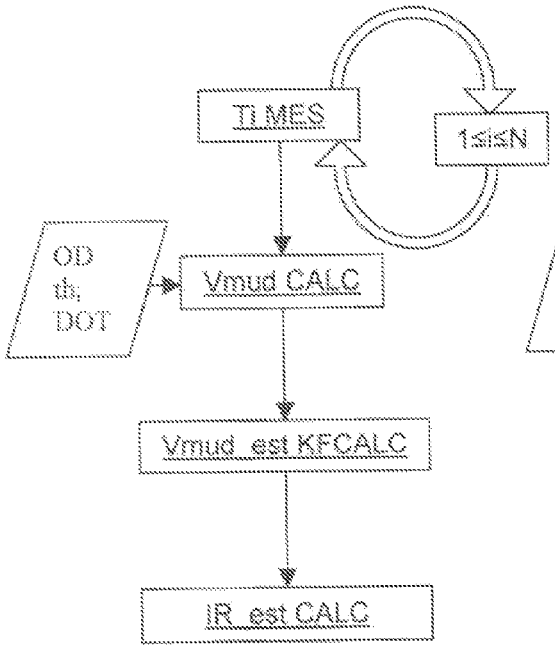
FIGS. 4A and 4B schematically illustrate a first embodiment and a second embodiment of the ultrasonic estimating method according to the invention, respectively.

FIG. 4A illustrates the first embodiment of the method of the invention which consists in applying a standard Kalman filter (calculating step Vmud_est KFCALC) to the output of the mud velocity equation (5).

The standard Kalman filter is an algorithm in control theory introduced by R. Kalman in 1960. It is an algorithm which makes optimal use of imprecise data on a linear or nearly linear system with Gaussian errors. The algorithm continuously updates a best estimate of a system current state. Further theoretical explanation with regards to the Kalman filter can be found in Ludeman L. C. "Random Processes: Filtering, Estimation and Detection", New York, Wiley-IEEE Press, 2003.

The first embodiment of the method of the invention assumes that the mud velocity slowly vary from a first depth z−1 to a second depth z. The estimated mud velocity Vmud_est at the second depth z is given by:

$$Vmud_est(z) = Vmud_est(z-1) + Kz \cdot (Vmud - Vmud_est(z-1)) \tag{6}$$

where Kz is the Kalman gain and Vmud_est(z−1) is the estimated mud velocity at the first depth z−1.

The Kalman gain depends on an assumed standard deviation of the mud velocity value from depth to depth.

The accuracy of the determination of the estimated mud velocity Vmud_est at the second depth z based on equation (6) is better than the calculation of the mud velocity based on equation (5).

Subsequently, the estimated mud velocity Vmud_est may be used to estimate with a better accuracy the inner dimension of the casing (radius or diameter) from equation (1). The calculation of the estimated casing inner radius IR_est (calculating step IR_est KFCALC) is given by:

$$\text{IR_est} = \frac{T \cdot \text{Vmud_est} + DOT}{2} \tag{7}$$

Figure 4B:
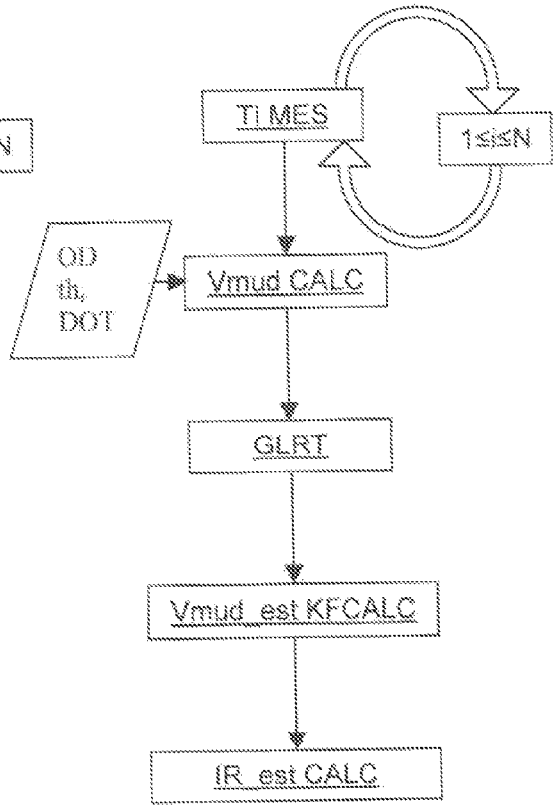

FIG. 4B illustrates the second embodiment of the method of the invention which consists in applying a generalized likelihood ratio test (testing step GLRT) before the standard Kalman filter to the output of the mud velocity equation (5).

The likelihood ratio test is a statistical test of the goodness-of-fit between two models. The test enables to distinguish between two hypotheses H0 and H1. For each hypothesis and the observed data, it is assumed that the maximum likelihood that data would have arisen if hypothesis H0 was true is L0 and the maximum likelihood that data would have arisen if hypothesis H1 was true is L1. The ratio L1/L0 is called the likelihood ratio and is the basis of likelihood ratio tests. For composite hypotheses the generalized likelihood ratio test is commonly applied. Further theoretical explanation with regards to the generalized likelihood ratio test can be found in Kay S. M., "Fundamentals of Statistical Signal Processing: volume 2: Detection Theory", Englewood Cliffs, Prentice Hall, 1998 and Gustafsson F. "Adaptive Filtering and Change Detection", New York, Wiley, 2000.

The second embodiment is particularly well suited for dealing with layers of different mud in the casing. In that case, the assumption of slow variation of mud velocity is no more valid at the interface between two layers of mud.

Before updating Vmud_est in equation (6), the generalized likelihood ratio test is applied on the difference (Vmud−Vmud_est(z−1)). The test compares the two hypotheses:

- hypothesis H0: the mean value of mud velocity is identical to V0, and V0=Vmud_est(z−1),
- hypothesis H1: the mean value of mud velocity is V1 different to V0 and unknown.

A computer program product comprising a set of instructions that, when loaded into a program memory of the electronic arrangement coupled to the measuring arrangement may causes the electronic arrangement to carry out the steps of the method of the invention.

The hereinbefore-described ultrasonic estimating method according to the second embodiment of the invention has been applied to actual data from a first (first example) and a second (second example) oilfield tests.

Figure 5A:
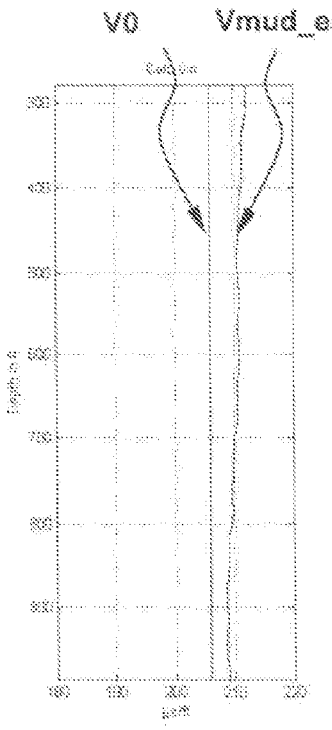
FIGS. 5A, 5B and 5C correspond to a first example showing estimated mud velocity, estimated inner casing radius estimated with the method of the invention, and a prior art computed inner casing radius, as a function of depth, respectively.
Figure 5B:
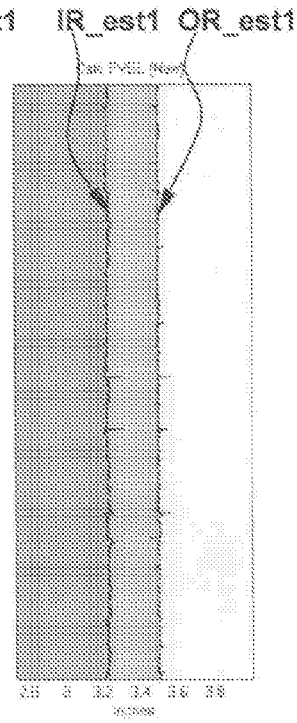
Figure 5C:
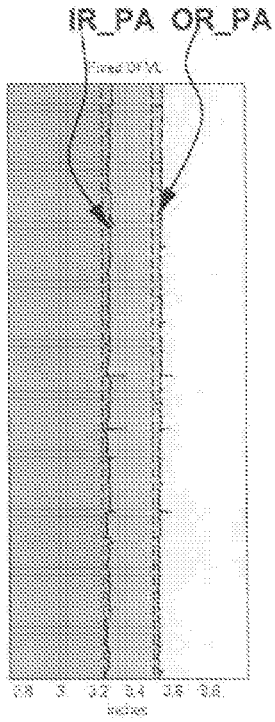

FIGS. 5A, 5B and 5C correspond to the first example relating to a smooth mud velocity variation with depth.

FIG. 5A shows estimated mud velocity Vmud_est1 curve as a function of depth and estimated according to the method of the invention. The estimated mud velocity Vmud_est1 curve is compared to the constant mud velocity V0 hypothesis.

FIG. 5B shows estimated inner casing radius IR_est1 and outer casing radius OR_est1 curves as a function of depth and estimated according to the method of the invention.

FIG. 5C shows a prior art computed inner casing radius IR_PA and outer casing radius OR_PA curves as a function of depth. The prior art inner casing radius and outer casing radius are calculated base on a constant mud velocity V0 hypothesis.

The curves obtained with the method of the invention results in a correct and accurate determination of the mud velocity and casing dimension.

Figure 6A:
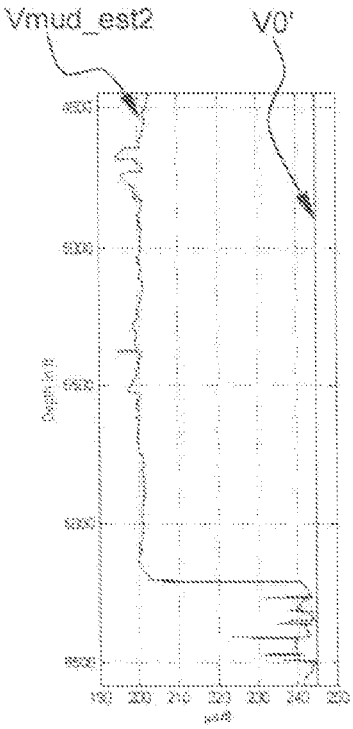
FIGS. 6A, 6B and 6C correspond to a second example showing estimated mud velocity, estimated inner casing radius estimated with the method of the invention, and a prior art computed inner casing radius, as a function of depth, respectively.
Figure 6B:
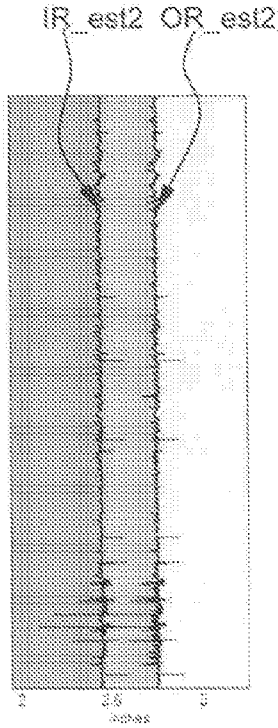
Figure 6C:
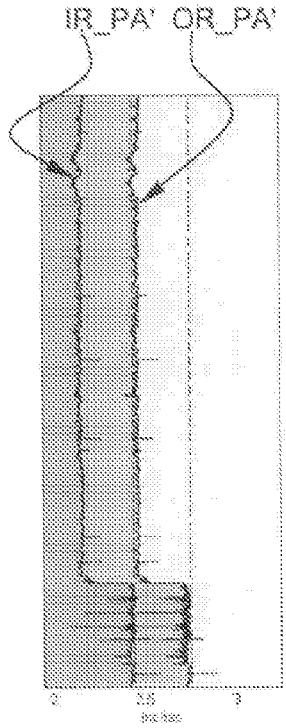

FIGS. 6A, 6B and 6C correspond to the second example relating to varying mud velocities with depth.

FIG. 6A shows estimated mud velocity Vmud_est2 curve as a function of depth and estimated according to the method of the invention. The estimated mud velocity Vmud_est2 curve is compared to the constant mud velocity V0' hypothesis.

FIG. 6B shows estimated inner casing radius IR_est2 and outer casing radius OR_est2 curves as a function of depth and estimated according to the method of the invention.

FIG. 6C shows a prior art computed inner casing radius IR_PA' and outer casing radius OR_PA' curves as a function of depth. The prior art inner casing radius and outer casing radius are calculated base on a constant mud velocity V0' hypothesis.

The curves obtained with the method of the invention results in a correct and accurate determination of the mud velocity and casing dimension because the delay to detect the change of mud velocity is minimized compared to prior art method.

Final Remarks

It will be apparent to a person skilled in the art that, though, a particular example pertaining to an onshore wireline logging was described in details, the invention is also applicable to other type of situation, e.g. offshore location.

The drawings and their description hereinbefore illustrate rather than limit the invention.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. An ultrasonic estimating method for estimating a mud velocity in a casing by means of an ultrasonic estimating apparatus comprising a transducer and adapted to be positioned inside the casing and displaced through the casing at a plurality of azimuth and a plurality of depth, the method comprising the steps of:

a) for a first depth and a first azimuth of the ultrasonic measuring arrangement:

a1) emitting an emission ultrasonic wave towards the casing for exciting the casing with a sensibly normal incidence, a2) receiving a reflection ultrasonic wave reflected from the casing, a3) measuring a transit time between the emitting step and the receiving step, a4) determining the casing thickness for the first azimuth, and b) repeating the emitting step a1), the receiving step a2), the measuring step a3) and the determining step a4) for the first depth and at least a second azimuth of the ultrasonic measuring arrangement, wherein the method further comprises the steps of:

c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value based on the intermediate mud velocity value and an estimated first depth mud velocity value.

2. An ultrasonic estimating method according to claim 1, wherein the calculating step d) applies a Kalman filtering.

3. An ultrasonic estimating method according to claim 2, wherein the Kalman filtering comprises estimating a second depth mud velocity value by calculating a sum of the estimated first depth mud velocity value with a product of a Kalman gain with a difference between the intermediate mud velocity value and the estimated first depth mud velocity value Vmud_est(z)=Vmud_est(z−1)+Kz×(Vmud−Vmud_est(z−1)).

4. An ultrasonic estimating method according to claim 2, wherein the calculating step d) further comprises the steps of applying a generalized likelihood ratio test before applying the Kalman filtering.

5. An ultrasonic estimating method according to claim 4, wherein the generalized likelihood ratio test comprises comparing a first hypothesis to a second hypothesis, the first hypothesis comprises assuming that the estimated first depth mud velocity value is equal to an initial mud velocity value and the second hypothesis comprises assuming that the estimated first depth mud velocity value is different from the initial mud velocity value and unknown.

6. An ultrasonic estimating method for estimating an inner diameter of a casing by means of an ultrasonic measuring arrangement comprising a transducer and adapted to be positioned inside the casing and displaced through the casing at a plurality of azimuth and a plurality of depth, the method comprising the steps of:

estimating a mud velocity according to a method for estimating a mud velocity in a casing according to claim 1, and calculating an estimated casing inner diameter at the second depth based on the measured transit time, the diameter of the transducer and the estimated second depth mud velocity value:

$$\mathrm{IR_est} = \frac{T \times \mathrm{Vmud_est} + DOT}{2}.$$

7. An ultrasonic estimating apparatus for estimating a mud velocity in a casing comprising a transducer and an electronic arrangement, adapted to be positioned inside the casing and displaced through the casing at a plurality of azimuth and a plurality of depth, the apparatus measuring a transit time between an emission of an ultrasonic wave towards the casing and the reception of the ultrasonic wave reflected from the casing, wherein the electronic arrangement comprises a processing circuit for:

a) determining the casing thickness for a first depth and a first azimuth of the transducer based on a first transit time measurement, b) determining the casing thickness for the first depth and at least a second azimuth of the transducer based on a second transit time measurement, c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value based on the intermediate mud velocity value and an estimated first depth mud velocity value.

8. An ultrasonic estimating apparatus according to the claim 7, wherein the processing circuit applies a Kalman filtering in the calculating step d).

9. An ultrasonic estimating apparatus according to claim 8, wherein the processing circuit further applies a generalized likelihood ratio test before applying the Kalman filtering.

10. An ultrasonic estimating apparatus according to claim 7, wherein the processing circuit further calculates an estimated casing inner diameter at the second depth based on the measured transit time, the diameter of the transducer and the estimated second depth mud velocity value.

11. A computer program product for an ultrasonic estimating apparatus for estimating a mud velocity in a casing, the apparatus comprising an ultrasonic transducer and an electronic arrangement, adapted to be positioned inside the casing and displaced through the casing at a plurality of azimuth and a plurality of depth, the apparatus measuring a transit time between an emission of an ultrasonic wave towards the casing and the reception of the ultrasonic wave reflected from the casing, the computer program product comprising a set of instructions that, when loaded into a program memory of the electronic arrangement, causes the electronic arrangement to carry out the steps of:

a) determining the casing thickness for a first depth and a first azimuth of the transducer based on a first transit time measurement, b) determining the casing thickness for the first depth and at least a second azimuth of the transducer based on a second transit time measurement, c) calculating an intermediate mud velocity value based on the measured transit time, the determined casing thickness, a diameter of the transducer and a casing outer diameter for the first depth, and for the first azimuth and at least the second azimuth, and d) calculating an estimated second depth mud velocity value based on the intermediate mud velocity value and an estimated first depth mud velocity value.

* * * * *